US009955742B2

(12) United States Patent
Lopez

(10) Patent No.: US 9,955,742 B2
(45) Date of Patent: May 1, 2018

(54) HEALTH SUIT WITH IMPROVED HEALTH AND TANNING BENEFITS IN VARIOUS WEATHER CONDITIONS

(71) Applicant: Esteban Lopez, New York, NY (US)

(72) Inventor: Esteban Lopez, New York, NY (US)

(73) Assignee: TanRound LLC, Los Angeles, CA (US)

( * ) Notice: Subject to any disclaimer, the term of this patent is extended or adjusted under 35 U.S.C. 154(b) by 210 days.

(21) Appl. No.: 14/859,211

(22) Filed: Sep. 18, 2015

(65) Prior Publication Data

US 2017/0079341 A1 Mar. 23, 2017

(51) Int. Cl.

| | |
|---|---|
| ***A41D 7/00*** | (2006.01) |
| ***A41D 31/02*** | (2006.01) |
| ***A41D 27/10*** | (2006.01) |
| ***A41D 31/00*** | (2006.01) |
| ***A41D 1/02*** | (2006.01) |
| *A41D 13/00* | (2006.01) |

(52) U.S. Cl.

CPC ..... *A41D 31/02* (2013.01); *A41D 1/02* (2013.01); *A41D 27/10* (2013.01); *A41D 31/00* (2013.01); *A41D 13/0015* (2013.01); *A41D 2400/10* (2013.01); *A41D 2400/28* (2013.01); *A41D 2400/62* (2013.01)

(58) Field of Classification Search

CPC ..... A41D 15/00; A41D 7/00; A41D 13/0015; A41D 13/018; A41B 13/06

See application file for complete search history.

(56) References Cited

U.S. PATENT DOCUMENTS

| | | | | |
|---|---|---|---|---|
| 2,391,959 A | | 1/1946 | Gallowhur | |
| 2,412,415 A | * | 12/1946 | Navon | A41D 3/08 135/16 |
| 2,478,765 A | | 8/1949 | Kim | |
| 2,649,584 A | * | 8/1953 | Chappell | G21F 3/02 2/457 |
| 2,966,155 A | * | 12/1960 | Krupp | A62B 17/008 128/202.11 |
| 4,161,180 A | | 7/1979 | Tiger | |
| 4,356,570 A | | 11/1982 | Vernon et al. | |
| 4,546,493 A | | 10/1985 | Bortnick | |
| 4,753,239 A | | 6/1988 | Vitolo | |
| 5,518,798 A | | 5/1996 | Riedel | |
| 2008/0066211 A1 | | 3/2008 | Laugt et al. | |

FOREIGN PATENT DOCUMENTS

| | | | | |
|---|---|---|---|---|
| CA | 2506108 A1 | | 9/2006 | |
| GB | 2449627 A | * | 12/2008 | A41D 7/00 |
| GB | 2452762 A | | 3/2009 | |

* cited by examiner

*Primary Examiner* — Tejash Patel

(74) *Attorney, Agent, or Firm* — Gabriel & Pelaez, PLLC; Michael G. Gabriel

(57) ABSTRACT

A health suit for improving sweating and tanning in various weather conditions includes a transparent material that is configured to allow ultraviolet rays and infrared energy to pass through the material and penetrate the skin with minimal deflection or absorption by the material. The health suit may also include an anti-fog layer or other set of anti-fogging features, moisture absorbing material, and a heat retention feature to improve sweating and tanning in various weather conditions.

20 Claims, 4 Drawing Sheets

HEALTH SUIT WITH IMPROVED HEALTH AND TANNING BENEFITS IN VARIOUS WEATHER CONDITIONS

TECHNICAL FIELD

Embodiments described herein generally relate to the field of healthcare garments, and particularly to a health suit that improves health and tanning benefits for a user in various weather conditions by combining the capabilities and design of a sweat suit and a tanning suit.

BACKGROUND

The therapeutic and cosmetic effects of exposing a person's body to sunlight are well known. Sunlight, for example, is an important source of a body's ability to produce Vitamin D. Currently, millions of people in the world suffer from various diseases or conditions that may be exacerbated by lack of adequate exposure to sunlight, or ameliorated by additional exposure to sunlight. These conditions may include diabetes, elevated blood pressure, heart disease, multiple sclerosis, osteomalacia, osteoporosis, psoriasis, rickets, seasonal affective disorder, tooth decay, tuberculosis and cancer. However, due to seasonal changes or weather conditions, the benefits of sunlight are not always available.

Several methods have been used to increase our exposure to light such as, for example, using artificial UV rays in tanning salons or using transparent clothing garments outdoors that allow natural sun light to penetrate the garment in cold/cool seasons while still providing thermal protection against the cold. Other garments like rain coats or similar PVC or plastic garments that are slightly transparent are available, but they are not made specifically to allow ultraviolet rays to penetrate the outer layer in order to maximize health benefits.

The benefits of body sweating have also been explored, for example, for detoxification and weight loss purposes, improved absorption of vitamin D and lowering of blood pressure. The most widely used methods to stimulate body sweating has been through physical activity or use of clothing garments that facilitate sweating such as layered reducing garment and sweat suits. These garments trap body heat and block wind creating a sauna effect to facilitate weight loss. However, these garments are opaque and are not useful for tanning purposes.

Current health suits do not adequately provide health and tanning benefits to a user at the same time. Therefore, a garment that can effectively stimulate body sweating and tanning for a user at the same time would be desirable. The positive effects of the sun exposure and of the sweating may be found to be amplified by the combination of the two effects in the health suit described herein. For example, a wearer may lose weight as its body works to cool itself. The increased body heat from the tanning aspects of the health suit may further increase a wearer's heart rate, thus increasing cardiac output and also metabolic rates. Consequently a wearer may then burn additional calories increasing the health effects sought through the sweating aspects. Further, a wearer may have health benefit from vitamin D absorption from sunlight. The increase in skin pore openings or improved blood circulation that may result from the sweating aspects of the health suit may improve the tanning aspects of the suit as well, further increasing a wearer's ability to absorb vitamin D more effectively and enhance melanin production and skin pigmentation through the wearer's increased pore openings.

SUMMARY OF THE INVENTION

A health suit includes a clothing garment such as pants, jacket, etc. that may be made of a clear material such as PVC, polyurethane or other clear plastics. The clear material is transparent to ultra violet rays and infra-red energy, which may pass through and penetrate the skin of a user with minimal deflection or absorption by the material helping to warm the skin by up to approximately 15 degrees Fahrenheit warmer than if just standing in a shadow. The health suit may include an anti-fog layer on a surface of the clear material for preventing condensation of fog on the surface of the material. Also, the garment may include a plurality of selectively removable moisture absorbing materials such as strips of microfiber or any absorbent cloth inside of the suit that may collect sweat droplets and a plurality of heat retention features that trap heat inside the suit through the use of selectively fixable connectors that enclose openings in the health suit.

BRIEF DESCRIPTION OF THE DRAWINGS

The advantages and novel features of the present invention will become apparent from the following description of the embodiments of the invention illustrated in the accompanied drawings, in which same numerals are used to designate the same elements throughout.

DESCRIPTION OF EMBODIMENTS

In the following description, for purposes of explanation, numerous specific details are set forth in order to provide a thorough understanding of the invention. It will be apparent, however, to one skilled in the art that the invention may be practiced without these specific details. In other instances, structure and devices are shown in block diagram form in order to avoid obscuring the invention. References to numbers without subscripts or suffixes are understood to reference all instance of subscripts and suffixes corresponding to the referenced number. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Embodiments disclosed herein include a health suit made from one or more garments or garment portions. Each garment made of a material that may allow a user of the garment to have the combined health benefits of body sweating and tanning at the same time using sunlight or other UV source. Each garment may be used in varying weather conditions and can be made of a material that is wind blocking yet may allow ultraviolet rays and infrared energy to be transmitted directly to the skin with minimal deflection, diffraction, or absorption by the material of the garment. In an embodiment, each garment may be made of varying thickness that can be used in varying weather conditions. Each garment is configured to retain body heat inside the garment during use and can include anti-fogging material to prevent fogging inside the garment, thereby maximizing tanning effects while using each garment. The garment may include features that prevent diffraction of ultraviolet rays and infrared energy to sweat droplets by, in embodiment, absorbing sweat droplets from a user's skin.

Figure 1:
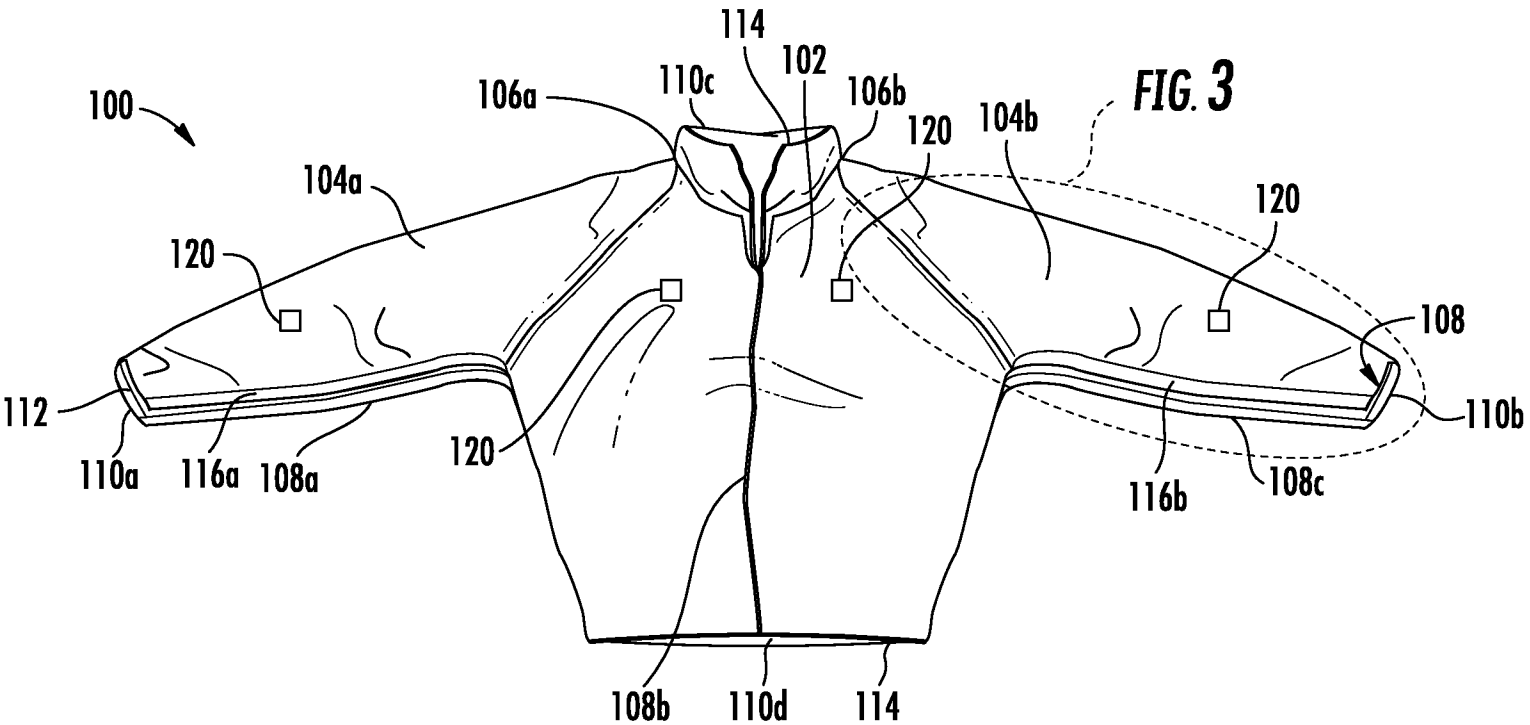
FIG. 1 is a front view of a first portion of a health suit, which is depicted in the form of a shirt or jacket according to an embodiment.

Referring to the figures, FIG. 1 illustrates a top portion 100 of a health suit according to an embodiment. In an embodiment, the health suit may be a garment that is formed by selectively attaching independent and separate portions of a garment to form the health suit having openings for allowing a user to wear and/or remove the health suit with minimal effort. The health suit is configured to be worn by a user or person so as to provide the combined health benefits of sweating and tanning to the user. For example, the health suit may be formed by selectively attaching one or more garments, for example, a shirt or jacket that is attached to pants to form the health suit. In embodiments, the shirt and pants can be worn singly or together depending on a user's therapeutic and aesthetic needs. In embodiments, the garment may be a top portion comprising torso portion, and sleeve portions, or the garment may be a bottom portion comprising a body portion and leg portions, also depending on a user's therapeutic and aesthetic needs. While health suit is depicted as a combination of selectively attaching separate garments, for example, a shirt/jacket to pants, in another embodiment, the health suit may be formed of a one-piece garment comprising a shirt portion and a pant portion that may be fixedly attached together, for example, a jumpsuit, while providing all of the benefits of body sweating and tanning in varying weather conditions and in a relatively short amount of time.

As shown in FIG. 1, top portion 100 may be made of a clear material such as PVC, polyurethane, or other clear plastics. The clear material is configured to allow light rays and light energy, for example, sunlight or artificial light to pass through the clear material and penetrate the skin directly with minimal deflection of ultra violet rays and infrared energy thereby causing an increase in the wearer's body temperature. In other embodiments, the clear material may have a filter that allows different wavelengths of light to penetrate the surface of the top portion 100.

Top portion 100 may comprise a torso portion 102 and substantially similar and detachable sleeve portions 104*a*, 104*b*. The detachable sleeve portions 104*a*, 104*b* may be selectively attached to torso portion 102 at lateral areas 106*a*, 106*b* of the torso portion 102. The torso portion 102 is configured to receive a user's upper body (i.e., chest area) while the sleeve portions 104*a*, 104*b* are configured to receive a user's arms. In some non-limiting examples, torso portion 102 and sleeve portions 104*a*, 104*b* may include complementary hook and loop connectors (not shown) such as, for example, Velcro® (manufactured by Velcro industries), pins, zippers, hooks or other similar and selectively detachable materials that may allow a user to selectively connect each sleeve portion 104*a*, 104*b* to torso portion 102. Selectively removing the sleeve portions 104*a*, 104*b* from the torso portion 102 may provide the user with the convenience of easily assembling the health suit for use or disassembling the health suit for applying skin products or for washing the health suit after use. The sleeves 104 may be configured to not be detachable in an embodiment. For example, a version of the health suit may be offered with the sleeves 104 sewn or bonded with heat through PVC melting onto the torso 102 making sleeves a part of the torso 102.

Top portion 100 may include connectors 108*a*, 108*b* and 108*c* for selectively closing the top portion 100 so as to contain heat and/or prevent heat from escaping the top portion 100 during use. Connectors 108*a*-108*c* can include zippers or Velcro®, but other similar connectors are also contemplated in embodiments. Top portion 100 may also include strips or pieces 116*a*-116*b* of moisture absorbing material, or an absorbent powder in a container, that may be attached or stuck inside the health suit or may be connected to inside surfaces of one or more of the torso portion 102 or the sleeves portions 104*a*-104*b*. In an embodiment, as shown in FIG. 1, the strips or pieces 116*a*-116*b* may be immediately adjacent and coextensive with connectors 108*a*-108*c* and may be configured to collect sweat droplets from a user of top portion 100, for additional comfort and/or to prevent diffraction of ultra violet rays and infra-red energy. In another embodiment, multiple strips or pieces 116*a*-116*m* may be positioned at various locations of the top portion 100 based on preferences of the user. Positioning the strips may also allow for controlling the flow of sweat. For example, the strips or pieces 116*a*-116*b* may include features that may allow the strips or pieces 116*a*-116*b* to be selectively movable to various locations on top portion 100 based on preferences of the user of the top portion 100.

Top portion 100 may also include heat retention features 110*a*-110*d* that may be selectively attached to torso portion 102 and sleeve portions 104*a*-104*b*. For example, the heat retention features 110*a*-110*d* may include buttons, elastic bands, strings, Velcro®, or other similar features connected to distal portion 112 of the sleeve portions 104*a*-104*b* or distal portions 114 of torso portion 102. The heat retention features 110*a*-110*d* may be configured to enclose garment openings, for example, sleeve openings or neck openings against the respective body portions of a user of the top portion 100. The heat retention features 110*a*-110*d* function to trap body heat of a user inside the garment (i.e., top portion 100) and/or prevent excessive loss of body heat from the user during use thereby raising the temperature inside the top portion 100. Raising the temperature increases body sweating, improves blood circulation, and opens skin pores resulting in enhanced sweating and enhanced tanning.

Enhanced sweating may occur by wearing of the health suit due to the features of the suit, which may enhance the sweating characteristic, alone or in combination. Enhanced sweating may occur because of the increased amount of infrared energy that may be absorbed by the skin, from the transparency of suit allowing the sun's energy through so that more infrared and heat energy may be absorbed directly by the skin and not blocked by a user's garments. Enhanced sweating may also occur because of the increased heat trapping characteristics of the health suit through its enclosing design which closes gaps 110 through which heat may otherwise dissipate. Enhances sweating may occur due to the suit having a strategic thickness of material based on weather and desired goals (discussed below), so that, for example, a user may wear a thicker health suit, or health suit portions, and thus a warmer health suit on colder days. Enhanced sweating may also occur because the health suit allows for greater user comfort through sweat absorption strips 116. By wicking or removing moisture from the skin via absorption strips, a user will be more comfortable and likely to remain exposed to the sun's rays longer. Moreover, the wicking effect will allow more sunlight to directly hit the skin rather than being diffracted by sweat moisture, providing enhanced sweating. These features apply equally to a top 100 or bottom 200 portions.

Enhanced tanning may occur by wearing the health suit due to features discussed above that may enhance sweating, alone or in combination, with features of the suit meant to enhance tanning. For example, enhance tanning may occur due to the increased UV ray absorption by skin while wearing a transparent garment made of a non-UV diffracting material. Enhanced tanning is also possible due to antifogging properties (discussed below) of the material and due to the moisture absorption properties. Each may allow UV and infrared energy to pass directly to the skin while minimizing diffraction due to moisture either on the suit or on the skin itself. Moreover, the enhanced sweating discussed above, may stimulate increased blood circulation and opening of skin pores. These phenomena in turn, may lead to further enhanced tanning. These features too apply equally to a top 100 or bottom 200 portions.

In an embodiment, top portion 100 may also include anti-fogging features. For example, an anti-fogging feature could comprise an anti-fogging layer. Top portion 100 may be coated with an anti-fogging material to create an anti-fog layer along an interior surface of torso portion 102 and sleeves portion 104*a*-104*b* so as to prevent condensation on the interior surface of top portion 100. The anti-fogging material may help minimize fogging that may be caused by perspiration, or by temperature or pressure differences between the inside and outside of the suit. The anti-fog layer may be rubbed or sprayed on the PVC layer, or may be permanently applied into the PVC layer when the PVC is being created. For example, the anti-fog PVC may be created during the manufacturing process by mixing anti-fog solutions with the raw plastic.

The chemical composition of the anti-fog layer minimizes surface tension on the garment and may be in the form of a surfactant film or a hydrophilic surface. The anti-fog layer may be comprised of, but not limited to, various mixtures created from products such as, for example, detergents, wetting agents, foaming agents, emulsifiers and dispersants, hydrophilic liquids such as alcohols or soaps or commercial anti-fog solutions. Preventing condensation may allow for effective transmission of ultraviolet rays and infra-red energy to the user's body thereby increasing body warming and sweating. During use, due to the heat retention features 110*a*-110*d* of the garment and the anti-fogging layer, the body temperature may increase in a shorter period of time and enhance body sweating, causing the opening of skin pores, improving blood circulation and conditions for melanin production leading to enhanced tanning of the skin.

In an embodiment, top portion 100 may be made of varying thicknesses to suit a user's health needs and/or for various weather conditions. For example, the top portion 100 may be made thinner in order to provide health benefits of body sweating and tanning during mild weather conditions. Alternatively, the top portion 100 may be made thicker to provide the same health benefits of sweating and tanning in more severe and/or colder weather conditions. Optional heat sources, such as placing hand warmers may facilitate using the health suit in colder conditions as well. In an embodiment, the health suit may be worn over garments based on preference of a user, such as for warmth in colder conditions. Additionally, in an embodiment, the health suit may be worn over garments such as shorts or a bathing suit or other items for modesty purposes.

In an embodiment, top portion 100 may include sensors 120 that may be selectively attached at selected or predetermined locations on the top portion 100. Sensors 120 may be ultraviolet sensors and/or temperature sensors that may be attached to an internal surface of top portion 100 so as to measure an internal temperature inside the top portion. In another embodiment, temperature sensors may allow the user to determine the internal temperature and manipulate the heat retention features 110*a*-110*d* or pressure and temperature release valves 302 (FIG. 3) so as to adjust the internal temperature of the top portion 100 to a comfortable level during body sweating and tanning. Sensors 120 may communicate with health monitoring software or devices, such applications that run on Smartphone devices or other wearable technology that may be used for health and fitness monitoring. The sensors 120 may work in conjunction with other sensors such as heart rate monitors, blood pressure monitors, or other health monitors knows in the art.

Figure 2:
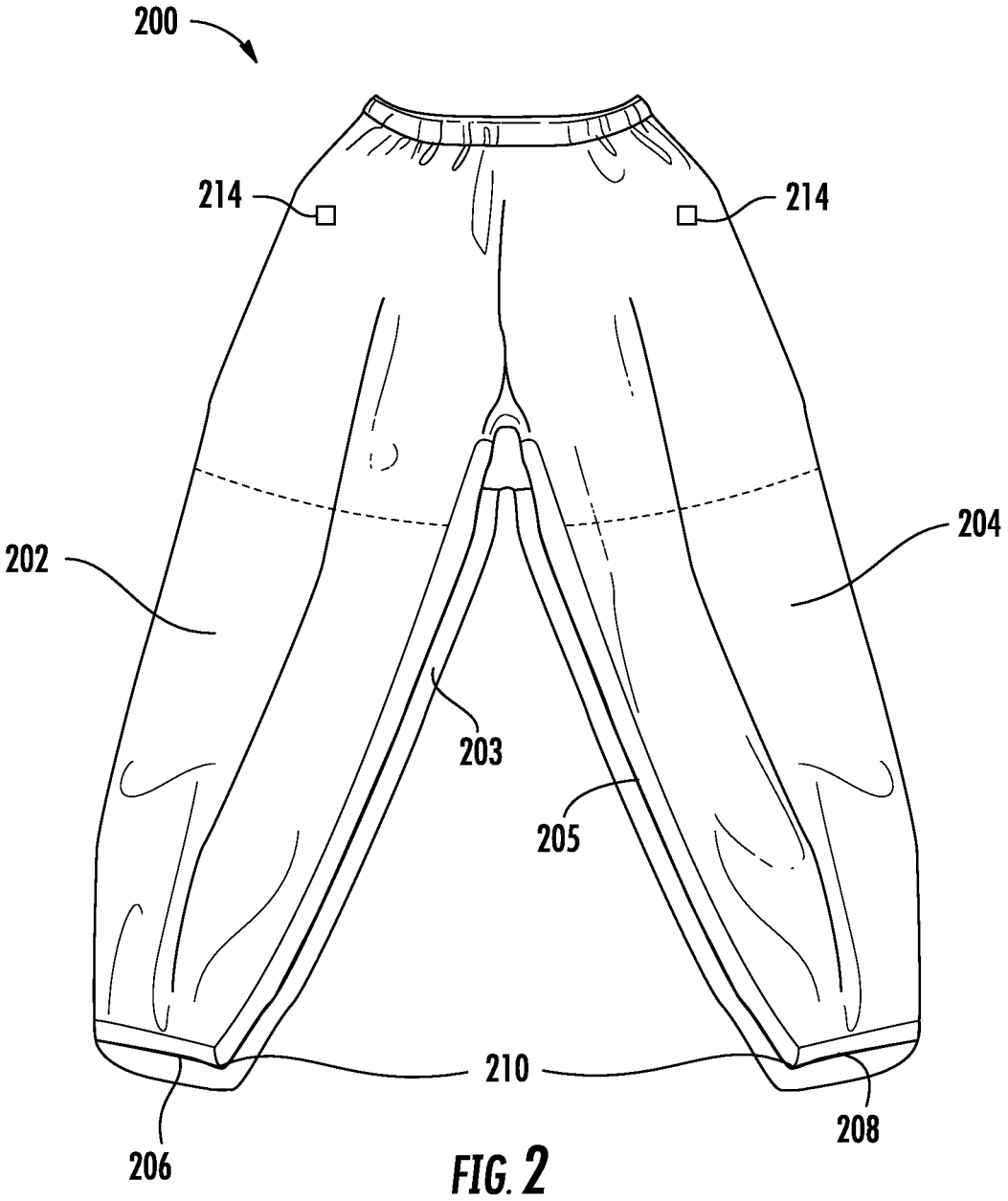
FIG. 2 is a front view of a second portion of a health suit, which is depicted in the form of pants according to an embodiment.

Referring to FIG. 2, a bottom portion 200 of a health suit is shown according to an embodiment of the invention. Bottom portion 200, for example, pants may include substantially similar features as top portion 100 which was shown and described above in FIG. 1. For example, bottom portion 200 may be made of clear material such as PVC, polyurethane, or other clear plastics. Bottom portion 200 includes leg portions 202, 204 that may be made to be selectively opened with connecting features. For example, each leg portion 202, 204 may include selectively connecting features 203, 205 that extends longitudinally along an inner medial line of each leg portion 202, 204, respectively. Particularly, connecting feature 203 is provided on leg portion 202 and connecting feature 205 is provided on leg portion 204. Connecting features 203, 205 include complementary connectors, for example, Velcro®, pins, hooks, zippers or similar connecting materials that facilitate closing each leg portion 202, 204 longitudinally along the inner medial line and containing body heat of a user of preventing cooler air from entering from an ambient environment (i.e., external to bottom portion 200). Also, the connecting materials may dissemble at the inner medial line of each leg portion 202, 204 so that a user may conveniently apply skin products during use of bottom portion 200 without removing the entire bottom portion 200 from the user's body.

Further, as an anti-fog feature, an internal surface of bottom portion 200 may be coated or coupled with anti-fogging material in order to minimize fogging caused by perspiration or temperature or pressure differences between the inside and outside of the suit. Also, heat retention features of bottom portion 200 are also the same as those in top portion 100 and may include buttons, elastic bands, strings, Velcro®, or other similar features to enclose garment openings 206, 208 (leg holes in leg portions 202, 204). Small strips or pieces of moisture absorbing material 210 may also be distributed on any part of bottom portion 200 so as to collect sweat droplets that may form on an inside surface of bottom portion 200. As shown in FIG. 2, absorbing material 210 may be coextensive with connecting features 203, 205.

In an embodiment, bottom portion 200 may also include sensors 214 that may be selectively attached at predetermined locations on the bottom portion 200. Sensors 214 may be ultraviolet sensors and/or temperature sensors that may be attached to an internal surface of bottom portion 100 so as to measure parameters associated with the sensors inside the bottom portion 100. In another embodiment, temperature sensors may allow the user to determine the internal temperature and manipulate the heat retention features in bottom portion 200 so as to adjust the internal temperature of the bottom portion 200 to a comfortable level during body sweating and tanning.

Figure 3:
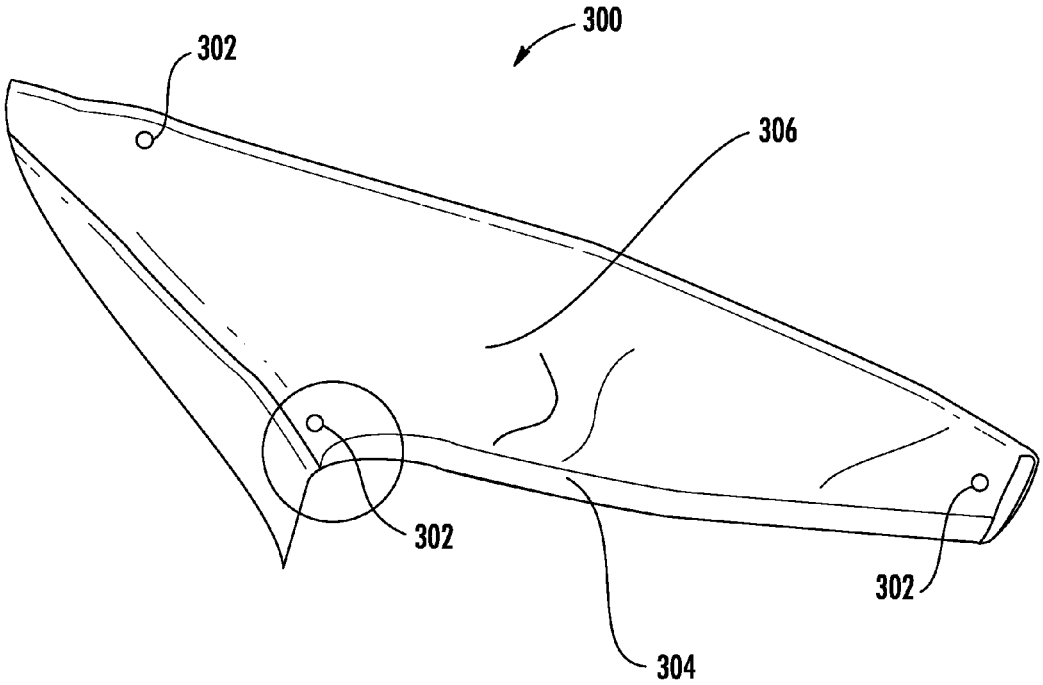
FIG. 3 is an expanded detail of a feature of a third portion of a health suit, which is depicted in the form of an attachment used with the first portion of the health suit of FIG. 1 according to an embodiment.

Referring to FIG. 3, an expanded detail of a feature of a sleeve 300 of top portion 100 is shown according to an embodiment. These features may also apply to a leg portion of bottom portion 200. Sleeve 300 may be substantially the same as either sleeve portion 104*a*-104*b* (FIG. 1). Sleeve 300 may include covered or uncovered pressure and temperature release valves 302 that may be dispersed on the sleeve 300 throughout the top portion 100. The size of the pressure and temperature release valves 302 may be in the range of approximately 1 millimeter to 9 centimeters. In an embodiment, the size of the valves 302 may be in the range of 5 millimeters to 4 centimeters. In another embodiment, the size of the valves 302 may be in the range of 1 to 3 centimeters. The pressure and temperature release valves 302 function to lower the relative humidity or partial pressure in the health suit with minimal loss of heat as compared to prior art health suits. The minimal heat loss facilitates retaining maximum internal temperature of the health suit which efficiently stimulates body sweating and tanning. Valves 302 may be designed to close or open and may regulate the temperature and the pressure gradient between the inside and outside of the suit. This may consequently help prevent fogging, and thus be another anti-fogging feature that may be applied separately or in combination with other anti-fogging features in various embodiments.

The pressure and temperature release valves 302 may be positioned in the sleeve 300, or any other part of the torso or upper body portion 100 or the legs or any part of the lower portion of health suit.

Figures 3A, 3B, 3C:
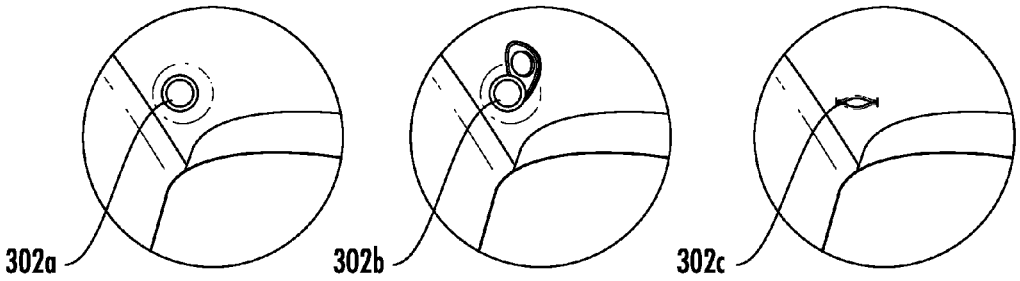
FIGS. 3*a*-3*c* are an expanded detail of a feature of a third portion of a health suit, which is depicted in the form of an attachment used with the first portion of the health suit of FIG. 1 according to embodiments.

The pressure and temperature release valves 302 may be permanently open 302A as illustrated in FIG. 3*a*, they may be coverable with flaps, covers, or the like, (FIG. 3*b*) allowing the wearer to open and close the pressure and temperature release valves 302B based on preference, body or skin temperature, sweat or humidity level within the health suit, or sensor 120 readings. Improvements in the field of nanotechnology may provide for more efficient or effective venting capability from the valves, and the size ranges could be adjusted accordingly. The pressure and temperature release valves 302 may also be in the form of small slits 302C as illustrated in FIG. 3*c*. The pressure and temperature release valves 302 may be positioned at or near body joints. The valves in the form of slits 302C would remain substantially closed while a wearer is not active or not moving. If a wearer engaged in exercise or physical activity, the body movement, such as bending one's appendages may force the slits open. This may serve as a relief valve, relieving the heat and humidity automatically and helping to prevent a wearer from overheating during exercise while wearing the health suit. Pressure and temperature release valves 302B may optionally operate similarly, by opening through wearer motion.

Sleeve 300 may also include a strip of moisture absorbing material 304 on an inside portion 306 of sleeve 300. In an example, moisture absorbing material 304 may be provided on an inside portion at an extremity of sleeve 300 (proximally where a user's wrists may rest) in order to collect sweat droplets or other moisture along the extremity of the arm. Benefits of collecting sweat droplets provide the user with comfort and prevent diffraction of solar radiation that may be present in conventional health suits. Another benefit of collecting moisture from within the suit may be a reduction in fog that may form within the suit. Thus the use of hydrophilic material within the suit may be yet another anti-fogging feature that may be applied separately or in combination with other anti-fogging features of the suit in different embodiments.

Figure 4:
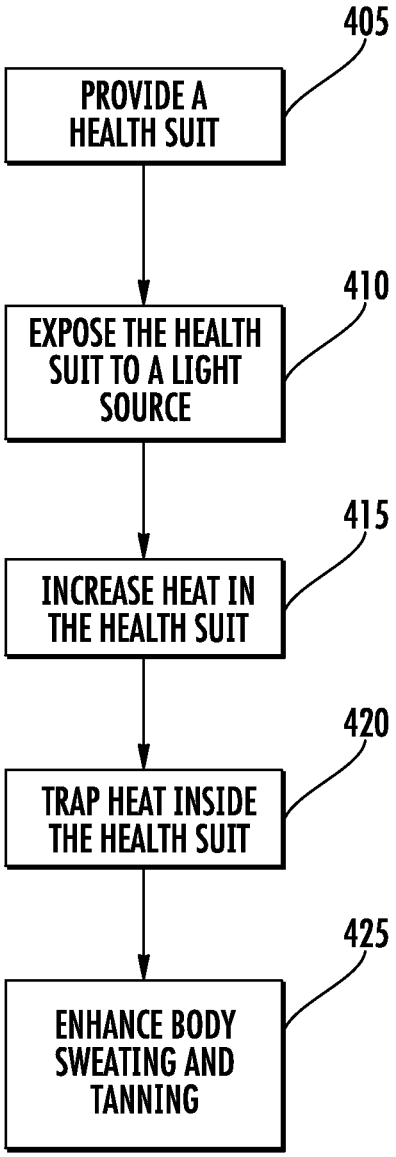
FIG. 4 is a method for providing health benefits and tanning benefits using a health suit according to an embodiment.

FIG. 4 illustrates a process for improving health and tanning benefits of a user of the health suit depicted in the embodiments of FIGS. 1-3 according to an embodiment of the invention. The process begins in 405 where a health suit is provided for use by a user. The health suit may include a top garment with a torso portion and a plurality of sleeves and a bottom garment with a plurality of leg portions. The top and bottom garments may be made of a clear material as described in embodiments above. The health suit may include heat retention elements on the top and bottom portions that are configured for trapping heat inside the health suit. The health suit may also include an anti-fog layer on an interior surface of the top and bottom garments, wherein the anti-fog layer is configured to prevent condensation on the inside surface. A removable moisture absorbing material on a portion of the interior surface is provided for collecting sweat droplets. In 410, the health suit with the user may be exposed to a light source thereby transmitting one or more of ultraviolet rays and infrared energy to an interior of the health suit. In 415, temperature and/or body heat of a user inside the health suit is increased in response to exposing the health suit to a light source. In 420, heat retention elements trap the body heat inside the health suit, raising the temperature inside the health suit. In 425, body sweating and improved blood circulation within the interior of the health suit is enhanced in response to the trapping of the heat.

Benefits of the embodiments described herein include a health suit that provides therapeutic and cosmetic effects by exposing a person's body to sunlight or a light source. The health suit may be made from one or more garments and may be used in varying weather conditions and can be made of a material that is wind blocking yet may allow ultraviolet rays and infrared energy to be transmitted directly to the skin with minimal deflection or absorption by the material of the garment. Exposing a user of the health suit may provide an important source of the body's ability to produce Vitamin D, which is important to prevent diseases exacerbated by lack of sunlight such as diabetes, elevated blood pressure, heart disease, multiple sclerosis, osteomalacia, osteoporosis, psoriasis, rickets, seasonal affective disorder, tooth decay and tuberculosis. The following examples pertain to further embodiments.

Example 1 is a health suit for body sweating and tanning, comprising: a first portion comprising a torso portion; a second portion, wherein each of the portions is made of a transparent material configured to permit ultra violet rays and infra-red energy to pass through each of the first and second portions with minimal deflection or absorption by the material; an anti-fog feature to prevent fog from condensing on an inside surface of each of the portions; a selectively removable absorbing material selectively disposed on the inside surface of the each of the portions, wherein the absorbing material is configured to collect moisture; and one or more heat retention features selectively attached to each of the portions, wherein the heat retention features are configured to trap heat inside each of the portions.

In Example 2, the subject matter of Example 1 can include, wherein the second portion comprises a plurality of leg portions.

In Example 3, the subject matter of Example 1 can include, wherein the first portion further comprises a plurality of sleeves that are selectively attached to the torso portion.

In Example 4, the subject matter of Example 3 can include, wherein the first portion is a shirt or jacket.

In Example 5, the subject matter of Example 3 can include, wherein the first portion may be selectively attached to each of the plurality of sleeves with zippers, buttons, elastic bands, strings or hook and loop connector for providing convenient disassembling of each of the plurality of sleeves from the first portion.

In Example 6, the subject matter of Example 1 can include, wherein the second portion is a pant.

In Example 7, the subject matter of Example 1 can include, wherein the transparent material is made from PVC, polyurethane or a clear plastic.

In Example 8, the subject matter of Example 1 can include, wherein an anti-fogging feature comprises absorbing material in the form of strips of microfiber or absorbent cloth.

In Example 9, the subject matter of Example 8 can include, wherein the absorbing material is connected to each of the portions at respective distal locations.

In Example 10, the subject matter of Example 1 can include, wherein the heat retention features are configured to be attached to at least distal areas of each of portion.

In Example 11, the subject matter of Example 10 can include, wherein the heat retention features includes buttons, elastic bands, strings, zippers, or hook and loop connectors.

In Example 12, the subject matter of Example 1 can include, wherein the second portion includes selectively connecting features that extend longitudinally along an inner medial line of each of the leg portions, the selectively connecting features includes zippers, buttons, elastic bands, strings or hook and loop connectors.

In Example 13, the subject matter of Example 1 can include vents in at least one of the first and second portions.

In Example 14, the subject matter of Example 13 can include, wherein each of the first and second portions include holes in the range of 1 millimeter to 3 centimeters, wherein the holes are configured for lowering at least one of a relative humidity or a partial pressure inside the respective first and second portion.

In Example 15, the subject matter of Example 1 can include, wherein each of the first and second portions include sensors that are selectively attached to an inside surface of at least one of the first and second portions.

In Example 16, the subject matter of Example 1 can include, wherein the first portion is configured to be selectively attached to the second portion to provide a unitary health suit.

Example 17 is a health suit for body sweating and tanning, comprising: a garment to cover at least an upper body portion comprising a transparent material configured to permit ultra violet rays and infra-red energy to pass through the garment with minimal deflection or absorption by the material configured for retaining body heat and blocking wind; an anti-fog layer on an inside surface of each of the portions, wherein the anti-fog layer is configured to prevent fog from condensing on the inside surface; a selectively removable absorbing material selectively disposed on the inside surface of the garment, wherein the absorbing material is configured to collect moisture droplets; at least one heat retainer disposed at a distal end of the at least an upper body portion of the garment to contain heat within the garment; and at least one selectively openable vent.

In Example 18, the subject matter of Example 17 can include, wherein the at least an upper body portion of the garment detachably attached to at least another body portion of the garment providing convenient disassembling of each portion of the garment.

Example 19 is a method for improving health and tanning benefits, comprising: providing a health suit configured for use by a user, wherein the health suit comprises: a top garment including a torso portion and a plurality of sleeves; a bottom garment including a plurality of leg portions, the top garment is configured to be selectively connected to the bottom garment; heat retention elements on each of the top and bottom garments that are configured for trapping heat inside the health suit; an anti-fog layer on an interior surface of at least one of the top and bottom garments, wherein the anti-fog layer is configured to prevent condensation on the inside surface; and a removable absorbing material on a portion of the interior surface that is configured for collecting moisture; wherein each of the top and bottom garments is made of clear material that is configured for allowing one or more of ultraviolet rays and infrared energy to penetrate the top and bottom garments with minimal deflection or absorption by the clear material; exposing the health suit to a light source thereby transmitting one or more of ultraviolet rays and infrared energy to an interior of the health suit; increasing heat within an interior of the health suit responsive to the exposing of the health suit to a light source; trapping the heat inside the health suit with the one or more heat retention elements; and enhancing body sweating and improved blood circulation within the interior of the health suit responsive to the trapping of the heat.

In Example 20, the subject matter of Example 19 can include, further comprising improving blood circulation for enhanced tanning of a user's skin responsive to the at least one of enhanced body sweating and improved blood circulation.

It is to be understood that the above description is intended to be illustrative, and not restrictive. For example, the above-described embodiments may be used in combination with each other. Many other embodiments will be apparent to those of skill in the art upon reviewing the above description. The scope of the invention therefore should be determined with reference to the appended claims, along with the full scope of equivalents to which such claims are entitled.

The invention claimed is:

1. A health suit for body sweating and tanning, comprising:

a first portion comprising a torso portion;

a second portion, wherein each of the first and second portions is made of a transparent material configured to permit ultra violet rays and infra-red energy to pass through each of the first and second portions with minimal deflection or absorption by the material;

an anti-fog feature to prevent fog from condensing on an inside surface of each of the first and second portions;

a selectively removable absorbing material selectively disposed on the inside surface of the each of the first and second portions, wherein the absorbing material is configured to collect moisture; and one or more heat retention features selectively attached to each of the first and second portions at a wrist or ankle, wherein the heat retention features are configured to trap heat inside each of the first and second portions.

2. The health suit of claim 1, wherein the second portion comprises a plurality of leg portions.

3. The health suit of claim 1, wherein the first portion further comprises a plurality of sleeves that are selectively attached to the torso portion.

4. The health suit of claim 1, wherein the first portion is a shirt or jacket.

5. The health suit of claim 3, wherein the first portion may be selectively attached to each of the plurality of sleeves with zippers, buttons, elastic bands, strings or hook and loop connector for providing convenient disassembling of each of the plurality of sleeves from the first portion.

6. The health suit of claim 1, wherein the second portion is a pant.

7. The health suit of claim 1, wherein the transparent material is made from PVC, polyurethane or a clear plastic.

8. The health suit of claim 1, wherein an anti-fogging feature comprises absorbing material in the form of strips of microfiber or absorbent cloth.

9. The health suit of claim 8, wherein the absorbing material is connected to each of the portions at respective distal locations.

10. The health suit of claim 1, wherein the heat retention features are configured to be attached to at least distal areas of each of portion.

11. The health suit of claim 10, wherein the heat retention features includes buttons, elastic bands, strings, zippers, or hook and loop connectors.

12. The health suit of claim 1, wherein the second portion includes selectively connecting features that extend longitudinally along an inner medial line of each of the leg portions, the selectively connecting features includes zippers, buttons, elastic bands, strings or hook and loop connectors.

13. The health suit of claim 1, further comprising vents in at least one of the first and second portions.

14. The health suit of claim 13, wherein each of the first and second portions include vents in the range of 1 millimeter to 3 centimeters, wherein the vents are configured for lowering at least one of a relative humidity or a partial pressure inside the respective first and second portion.

15. The health suit of claim 1, wherein each of the first and second portions include sensors that are selectively attached to an inside surface of at least one of the first and second portions.

16. The health suit of claim 1, wherein the first portion is configured to be selectively attached to the second portion to provide a unitary health suit.

17. A health suit for body sweating and tanning, comprising:

a garment to cover at least an upper body portion comprising a transparent material configured to permit ultra violet rays and infra-red energy to pass through the garment with minimal deflection or absorption by the material configured for retaining body heat and blocking wind;

an anti-fog layer on an inside surface of the garment, wherein the anti-fog layer is configured to prevent fog from condensing on the inside surface;

a selectively removable absorbing material selectively disposed on the inside surface of the garment, wherein the absorbing material is configured to collect moisture droplets;

at least one heat retainer disposed at a sleeve end of the at least an upper body portion of the garment to contain heat within the garment; and at least one selectively openable vent.

18. The health suit of claim 17, wherein the at least an upper body portion of the garment detachably attached to at least another body portion of the garment providing convenient disassembling of each portion of the garment.

19. A method for improving health and tanning benefits, comprising:

providing a health suit configured for use by a user, wherein the health suit comprises:

a top garment including a torso portion and a plurality of sleeves;

a bottom garment including a plurality of leg portions, the top garment is configured to be selectively connected to the bottom garment;

heat retention elements on each of the top and bottom garments that are configured for trapping heat inside the health suit;

an anti-fog layer on an interior surface of at least one of the top and bottom garments, wherein the anti-fog layer is configured to prevent condensation on the inside surface; and a removable absorbing material on a portion of the interior surface that is configured for collecting moisture;

wherein each of the top and bottom garments is made of clear material that is configured for allowing one or more of ultraviolet rays and infrared energy to penetrate the top and bottom garments with minimal deflection or absorption by the clear material;

exposing the health suit to a light source thereby transmitting one or more of ultraviolet rays and infrared energy to an interior of the health suit;

increasing heat within an interior of the health suit responsive to the exposing of the health suit to a light source;

trapping the heat inside the health suit with the one or more heat retention elements; and enhancing body sweating and improved blood circulation within the interior of the health suit responsive to the trapping of the heat.

20. The method of claim 19, further comprising improving blood circulation for enhanced tanning of a user's skin responsive to the at least one of enhanced body sweating and improved blood circulation.

* * * * *